US007087144B2

(12) United States Patent
Herchen

(10) Patent No.: US 7,087,144 B2
(45) **Date of Patent: *Aug. 8, 2006**

(54) CONTACT RING WITH EMBEDDED FLEXIBLE CONTACTS

(75) Inventor: Harald Herchen, Los Altos, CA (US)

(73) Assignee: Applied Materials, Inc., Santa Clara, CA (US)

( * ) Notice: Subject to any disclaimer, the term of this patent is extended or adjusted under 35 U.S.C. 154(b) by 241 days.

This patent is subject to a terminal disclaimer.

(21) Appl. No.: 10/355,479

(22) Filed: Jan. 31, 2003

(65) Prior Publication Data

US 2004/0149573 A1 Aug. 5, 2004

(51) Int. Cl.

| | |
|---|---|
| ***C25D 17/06*** | (2006.01) |
| ***C25D 17/08*** | (2006.01) |
| *C25D 7/12* | (2006.01) |
| *C25D 3/38* | (2006.01) |

(52) U.S. Cl. ..... 204/297.1; 204/285; 204/286.1; 204/287; 204/288.3; 204/297.01; 204/297.06; 204/297.14

(58) Field of Classification Search ..... 204/297.01
See application file for complete search history.

(56) References Cited

U.S. PATENT DOCUMENTS

| | | | | |
|---|---|---|---|---|
| 3,649,509 | A | 3/1972 | Morawetz et al. | 204/238 |
| 3,727,620 | A | 4/1973 | Orr | 134/95 |
| 3,770,598 | A | 11/1973 | Creutz | 204/52 R |
| 4,027,686 | A | 6/1977 | Shortes et al. | 134/33 |
| 4,092,176 | A | 5/1978 | Kozai et al. | 134/186 |
| 4,110,176 | A | 8/1978 | Creutz et al. | 204/52 R |
| 4,113,492 | A | 9/1978 | Sato et al. | 96/67 |
| 4,304,641 | A | 12/1981 | Grandia et al. | 204/23 |
| 4,315,059 | A | 2/1982 | Raistrick et al. | 429/112 |
| 4,326,940 | A | 4/1982 | Eckles et al. | 204/232 |
| 4,336,114 | A | 6/1982 | Mayer et al. | 204/52 R |
| 4,376,685 | A | 3/1983 | Watson | 204/52 R |
| 4,405,416 | A | 9/1983 | Raistrick et al. | 204/68 |
| 4,428,815 | A | 1/1984 | Powell et al. | 204/297 W |
| 4,435,266 | A | 3/1984 | Johnston | 204/276 |
| 4,489,740 | A | 12/1984 | Rattan et al. | 134/140 |
| 4,510,176 | A | 4/1985 | Cuthbert et al. | 427/82 |
| 4,518,678 | A | 5/1985 | Allen | 430/311 |

(Continued)

FOREIGN PATENT DOCUMENTS

| | | |
|---|---|---|
| JP | 58182823 | 10/1983 |

(Continued)

OTHER PUBLICATIONS

Colombo, "Wafer Back Surface Film Removal," Central R&D, SGS-Thomson Microelectronics, Agate Italy, No Date.

(Continued)

*Primary Examiner*—Harry D Wilkins, III
(74) *Attorney, Agent, or Firm*—Patterson & Sheridan LLP

(57) ABSTRACT

A contact assembly for supporting a substrate in an electrochemical plating system, wherein that contact assembly includes a contact ring and a thrust plate assembly. The contact ring includes an annular ring member having an upper surface and a lower surface, an annular bump member positioned on the upper surface, and a plurality of flexible and conductive substrate contact fingers extending radially inward from the lower surface. The thrust plate includes an annular plate member sized to be received within the annular ring member, and a seal member extending radially outward from the plate member, the seal member being configured to engage the annular bump member for form a fluid seal therewith.

6 Claims, 4 Drawing Sheets

U.S. PATENT DOCUMENTS

| | | | | |
|---|---|---|---|---|
| 4,519,846 | A | 5/1985 | Aigo | 134/15 |
| 4,693,805 | A | 9/1987 | Quazi | 204/192.22 |
| 4,732,785 | A | 3/1988 | Brewer | 427/240 |
| 4,789,445 | A | 12/1988 | Goffman et al. | 204/114 |
| 5,039,381 | A | 8/1991 | Mullarkey | 204/47.5 |
| 5,055,425 | A | 10/1991 | Leibovitz et al. | 437/195 |
| 5,092,975 | A | 3/1992 | Yamamura et al. | 204/198 |
| 5,155,336 | A | 10/1992 | Gronet et al. | 219/411 |
| 5,162,260 | A | 11/1992 | Leibovitz et al. | 437/195 |
| 5,222,310 | A | 6/1993 | Thompson et al. | 34/302 |
| 5,224,504 | A | 7/1993 | Thompson et al. | 134/155 |
| 5,230,743 | A | 7/1993 | Thompson et al. | 134/32 |
| 5,252,807 | A | 10/1993 | Chizinsky | 219/390 |
| 5,256,274 | A | 10/1993 | Poris | 205/123 |
| 5,259,407 | A | 11/1993 | Tuchida et al. | 134/151 |
| 5,281,325 | A | 1/1994 | Berg | 205/125 |
| 5,290,361 | A | 3/1994 | Hayashida et al. | 134/2 |
| 5,316,974 | A | 5/1994 | Crank | 437/190 |
| 5,328,589 | A | 7/1994 | Martin | 205/296 |
| 5,349,978 | A | 9/1994 | Sago et al. | 134/153 |
| 5,377,708 | A | 1/1995 | Bergman et al. | 134/105 |
| 5,429,733 | A | 7/1995 | Ishida | 204/224 R |
| 5,447,615 | A | 9/1995 | Ishida | 204/224 R |
| 5,516,412 | A | 5/1996 | Andricacos et al. | 204/224 R |
| 5,608,943 | A | 3/1997 | Konishi et al. | 15/302 |
| 5,625,170 | A | 4/1997 | Poris | 177/50 |
| 5,651,865 | A | 7/1997 | Sellers | 204/192.13 |
| 5,705,223 | A | 1/1998 | Bunkofske | 427/240 |
| 5,718,813 | A | 2/1998 | Drummond et al. | 204/192.12 |
| 5,723,028 | A | 3/1998 | Poris | 204/231 |
| 5,985,126 | A | 11/1999 | Bleck et al. | 205/123 |
| 6,001,234 | A | 12/1999 | Batz, Jr. et al. | 205/123 |
| 6,004,440 | A | 12/1999 | Hanson et al. | 204/279 |
| 6,004,828 | A | 12/1999 | Hanson | 438/7 |
| 6,080,291 | A | 6/2000 | Woodruff et al. | 204/297.1 |
| 6,090,711 | A | 7/2000 | Batz, Jr. et al. | 438/689 |
| 6,103,085 | A | 8/2000 | Woo et al. | 205/143 |
| 6,103,628 | A | 8/2000 | Talieh | 438/692 |
| 6,139,703 | A | 10/2000 | Hanson et al. | 204/212 |
| 6,139,712 | A | 10/2000 | Patton et al. | 205/143 |
| 6,159,354 | A | 12/2000 | Contolini et al. | 205/96 |
| 6,176,992 | B1 | 1/2001 | Talieh | 205/87 |
| 6,193,859 | B1 | 2/2001 | Contolini et al. | 204/224 R |
| 6,207,572 | B1 | 3/2001 | Talieh | 438/692 |
| 6,251,235 | B1 | 6/2001 | Talieh et al. | 204/220 |
| 6,251,250 | B1 | 6/2001 | Keigler | 205/89 |
| 6,258,220 | B1 * | 7/2001 | Dordi et al. | 204/198 |
| 6,270,647 | B1 | 8/2001 | Graham et al. | 205/99 |
| 6,271,433 | B1 | 8/2001 | Keady et al. | 585/802 |
| 6,274,010 | B1 | 8/2001 | Henington et al. | 204/230.3 |
| 6,274,013 | B1 | 8/2001 | Bleck et al. | 204/297.08 |
| 6,309,524 | B1 | 10/2001 | Woodruff et al. | 204/297.1 |
| 6,328,872 | B1 | 12/2001 | Talieh et al. | 205/206 |
| 6,343,793 | B1 | 2/2002 | Patton et al. | 277/361 |
| 6,352,623 | B1 | 3/2002 | Volodarsky et al. | 204/275.4 |
| 6,355,153 | B1 | 3/2002 | Uzoh et al. | 205/87 |
| 6,358,388 | B1 | 3/2002 | Bleck et al. | 205/118 |
| 6,398,926 | B1 * | 6/2002 | Mahneke | 204/224 R |
| 6,402,925 | B1 | 6/2002 | Talieh | 205/222 |
| 6,409,904 | B1 | 6/2002 | Uzoh et al. | 205/137 |
| 6,413,388 | B1 | 7/2002 | Uzoh et al. | 204/224 R |
| 6,413,403 | B1 | 7/2002 | Lindquist et al. | 205/97 |
| 6,464,571 | B1 | 10/2002 | Talieh et al. | 451/296 |
| 6,468,139 | B1 | 10/2002 | Talieh et al. | 451/296 |
| 6,471,847 | B1 | 10/2002 | Talieh et al. | 205/147 |
| 6,478,936 | B1 | 11/2002 | Volodarsky et al. | 204/286.1 |
| 6,482,307 | B1 | 11/2002 | Ashjaee et al. | 205/103 |
| 6,497,800 | B1 | 12/2002 | Talieh et al. | 204/224 R |
| 6,514,258 | B1 | 2/2003 | Brown et al. | 606/80 |
| 6,527,920 | B1 | 3/2003 | Mayer et al. | 204/237 |
| 6,534,116 | B1 | 3/2003 | Basol | 427/97 |
| 6,540,899 | B1 * | 4/2003 | Keigler | 205/118 |
| 6,736,945 | B1 * | 5/2004 | Ishida et al. | 204/212 |
| 2004/0074762 | A1 * | 4/2004 | Keigler et al. | 204/198 |

FOREIGN PATENT DOCUMENTS

| | | |
|---|---|---|
| JP | 63118093 | 5/1988 |
| JP | 6-17291 | 1/1994 |
| WO | 97/12079 | 4/1997 |
| WO | 99/25902 | 5/1999 |
| WO | 99/25903 | 5/1999 |
| WO | 99/25904 | 5/1999 |
| WO | 99/25905 | 5/1999 |
| WO | 99/26275 | 5/1999 |

OTHER PUBLICATIONS

Semitool Product Catalog (on-line) Oct. 27, 1998.

Singer, "Copper Has Enormous Benefits When Compared to Aluminum, but its Implementation Requires Some Fundamental Changes in Process Technologies," Semiconductor International Jun. 1998.

Singer, "Wafer Processing," Semiconductor International Jun. 1998.

Pitney, "Ney Contact Manual" Oct. 1974.

* cited by examiner

CONTACT RING WITH EMBEDDED FLEXIBLE CONTACTS

BACKGROUND OF THE INVENTION

1. Field of the Invention

Embodiments of the invention generally relate to electrochemical plating and, more particularly, to a contact ring for an electrochemical plating system.

2. Description of the Related Art

Metallization of sub-quarter micron sized features is a foundational technology for present and future generations of integrated circuit manufacturing processes. More particularly, in devices such as ultra large scale integration-type devices, i.e., devices having integrated circuits with more than a million logic gates, the multilevel interconnects that lie at the heart of these devices are generally formed by filling high aspect ratio (greater than about 4:1, for example) interconnect features with a conductive material, such as copper or aluminum, for example. Conventionally, deposition techniques such as chemical vapor deposition (CVD) and physical vapor deposition (PVD) have been used to fill these interconnect features. However, as the interconnect sizes decrease and aspect ratios increase, void-free interconnect feature fill via conventional metallization techniques becomes increasingly difficult. As a result thereof, plating techniques, such as electrochemical plating (ECP) and electroless plating, for example, have emerged as promising processes for void free filling of sub-quarter micron sized high aspect ratio interconnect features in integrated circuit manufacturing processes.

In an ECP process, for example, sub-quarter micron sized high aspect ratio features formed into the surface of a substrate (or a layer deposited thereon) may be efficiently filled with a conductive material, such as copper, for example. An ECP processes generally includes first depositing a seed layer over the surface and into features of the substrate (the seed layer deposition process is generally separate from the ECP plating process), and then the surface features of the substrate are exposed to an electrochemical plating solution, while an electrical bias is simultaneously applied between the substrate and an anode positioned in the plating solution. The plating solution is generally rich in positive ions to be plated onto the surface of the substrate, and therefore, the application of the electrical bias causes these positive ions to be urged out of the plating solution and to be plated onto the seed layer.

Typically, the electrical bias is provided to the substrate via one or more electrical contacts distributed around the perimeter of the substrate being plated. Commonly, the seed layer formed on the substrate may extend from a plating surface around beveled edges of the substrate, and possibly extend onto a non-plating surface or backside of the substrate. Accordingly, for different systems, the electrical contacts may be in electrical contact with either the plating surface (frontside) or the non-plating surface (backside) of the substrate. Regardless of location, it is generally desirable to isolate the electrical contacts, as well as the non-plating surface of the substrate from the plating material in order to avoid plating of the positive ions on the contacts, as plating on the electrical contacts may alter the resistance of the electrical contacts and have a negative effect on the substrate plating uniformity.

Conventional approaches to isolate the electrical contacts and non-plating surface from the plating solution typically include providing one or more sealing elements to contact the same surface of the substrate as the electrical contacts.

For example, sealing members positioned to engage the plating surface may be placed adjacent electrical contacts positioned to contact the plating surface. The sealing members and electrical contacts also provide support for the substrate. However, the combination of the electrical contacts and the associated seals generally takes up several millimeters (generally between 3 and about 7 millimeters) of the perimeter of the plating surface area. Since this surface area is used to make electrical and seal contacts, the area cannot be used to support device formation.

In an effort to utilize this perimeter surface area, some systems may include sealing members positioned to engage the non-plating surface adjacent electrical contacts positioned to contact the non-plating surface. However, without sealing members or electrical contacts on the plating surface to support the substrate, some other means may be needed to support the substrate. Typically, a vacuum is applied to the substrate, to pull the non-plating surface up into contact with the sealing members and electrical contacts. However, the vacuum applied to the substrate may create a stress on the substrate, and may lead to substrate breakage. If the sealing members happen to leak, the vacuum may be unable to maintain the substrate against the electrical contacts with sufficient force and the plating solution may enter the vacuum, causing damage to the vacuum. Further, in systems where the contact pins engage the plating surface of the substrate, the contact pins are generally surrounded by a seal configured to prevent the electroplating solution from coming into contact with the electrical contact pins. Although the concept of dry contact pins is noteworthy, there are several disadvantages of these configurations. Namely, dry contact configurations present challenges in maintaining a fluid tight seal between the substrate, and as such, fluid often penetrates the seals and is exposed to the contact pins, which alters the pin resistance and the plating uniformity. Additionally, conventional contact rings utilize fixed electrical contacts, and therefore, when a substrate being plated is not entirely planar, the various fixed contacts will have varying degrees of success contacting the substrate.

Therefore, there is a need for an improved apparatus for securing a substrate in an electrochemical plating system.

SUMMARY OF THE INVENTION

Embodiments of the invention generally provide a contact assembly for supporting a substrate in an electrochemical plating system, wherein that contact assembly includes a contact ring and a thrust plate assembly. The contact ring includes an annular ring member having an upper surface and a lower surface, an annular bump member positioned on the upper surface, and a plurality of flexible and conductive substrate contact fingers extending radially inward from the lower surface. The thrust plate includes an annular plate member sized to be received within the annular ring member, and a seal member extending radially outward from the plate member, the seal member being configured to engage the annular bump member for form a fluid seal therewith.

Embodiments of the invention further provide a contact ring for an electrochemical plating system. The contact ring generally includes an upper ring member, a lower ring member secured to the upper ring member via a plurality of support members, the lower ring member having an inwardly extending flange, a plurality of vertically flexible conductive contact pins extending radially inward from the lower ring member, an electrically insulating layer covering the plurality of the vertically flexible conductive contact pins, and a plurality of conductive tip members affixed to a terminating end of each of the plurality of vertically flexible conductive contact pins.

Embodiments of the invention further provide a substrate contact assembly for an electrochemical plating system. The substrate contact assembly generally includes an electrically conductive contact ring, a first electrically insulating layer covering outer surfaces of the contact ring, a plurality of electrically conductive flexible contact fingers extending radially inward from the contact ring, and a second electrically insulating layer covering a body portion of the contact fingers, the second electrically insulating layer being configured to flex with the contact fingers while maintaining electrical isolation of the body portion.

BRIEF DESCRIPTION OF THE DRAWINGS

So that the manner in which the above recited features of the invention can be understood in detail, a more particular description of the invention, briefly summarized above, may be had by reference to embodiments thereof, some of which are illustrated in the appended drawings. It is to be noted, however, that the appended drawings illustrate only typical embodiments of the invention, and are therefore, not to be considered limiting of its scope, for the invention may admit to other equally effective embodiments.

DETAILED DESCRIPTION OF THE PREFERRED EMBODIMENT

Embodiments of the invention generally provide a contact ring configured to secure and electrically contacting a substrate in an electrochemical plating system. The contact ring generally includes a plurality of electrical contact pins radially positioned and configured to electrically contact a substrate being plated proximate the perimeter of the substrate. Further, although the contact pins are embedded within an insulative body, the contact pins are configured to be partially flexible and implemented in a wet contact configuration.

Figure 1:
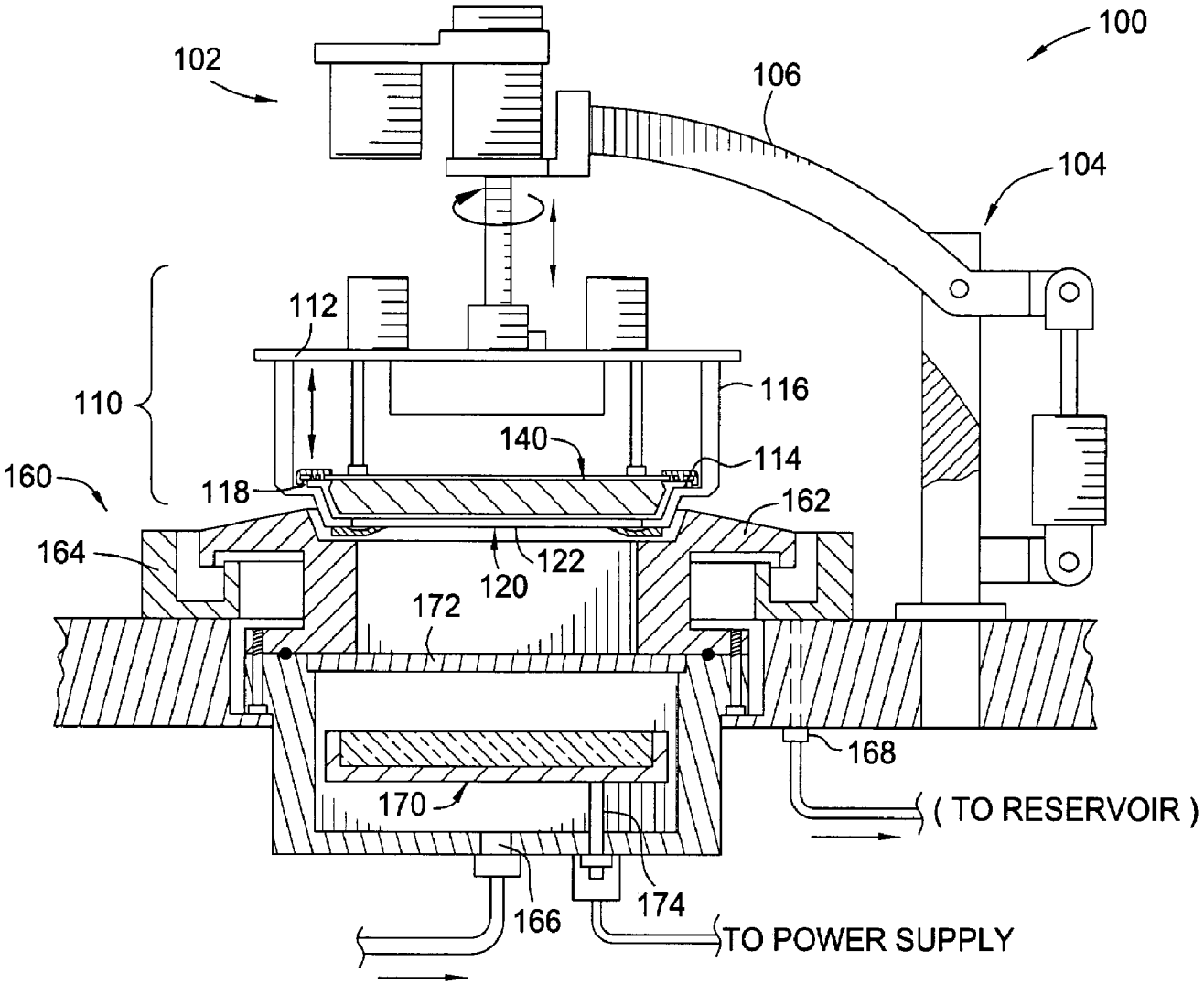
FIG. 1 illustrates a sectional view of an exemplary electrochemical plating cell incorporating an embodiment of a contact ring of the invention.

FIG. 1 illustrates a sectional view of an exemplary electrochemical plating (ECP) system 100 of the invention. The ECP system 100 generally includes a head assembly actuator 102, a substrate holder assembly 110, and a plating basin assembly 160. The head actuator assembly 102 is generally attached to a supporting base 104 by a pivotally mounted support arm 106. The head actuator assembly 102 is adapted to support the substrate holder assembly 110 (also generally referred to as an ECP contact ring) at various positions above the plating basin 160, and more particularly, the actuator assembly 102 is configured to position the substrate holder assembly 110 into a plating solution contained within basin 160 for plating operations. Head actuator 102 may generally be configured to rotate, vertically actuate, and tilt the substrate holder assembly 110 attached thereto before, during, and after the substrate 120 is placed in the plating solution.

The plating basin 160 generally includes an inner basin 162, contained within a larger diameter outer basin 164. Any suitable technique may be used to supply a plating solution to the plating assembly 160. For example, a plating solution may be supplied to the inner basin 162 through an inlet 166 at a bottom surface of the inner basin 162. The inlet 166 may be connected to a supply line, for example, from an electrolyte reservoir system (not shown). The outer basin 164 may operate to collect fluids from the inner basin 162 and drain the collected fluids via a fluid drain 168, which may also be connected to the electrolyte reservoir system and configured to return collected fluids thereto.

An anode assembly 170 is generally positioned in a lower region of inner basin 162. A diffusion member 172 may be generally positioned across the diameter of inner basin at a position above the anode assembly 170. The anode assembly 170 may be any suitable consumable or non-consumable-type anode, e.g., copper, platinum, etc. The diffusion member 172 may be any suitable type of permeable material, such as a porous ceramic disk member, for example. The diffusion member 172 is generally configured to generate an even flow of electrolyte solution therethrough in the direction of the substrate being plated, and further, to provide a degree of control over the electrical flux traveling between the anode and the substrate being plated. Any suitable method may be used to provide an electrical connection to the anode assembly 170. For example, an electrical connection to the anode assembly 170 may be provided through an anode electrode contact 174. The anode electrode contact 174 may be made from any suitable conductive material that is insoluble in the plating solution, such as titanium, platinum and platinum-coated stainless steel. As illustrated, the anode electrode contact 174 may extend through a bottom surface of the plating bath assembly 160 and may be connected to an electrical power supply (not shown), for example, through any suitable wiring conduit.

Figure 2:
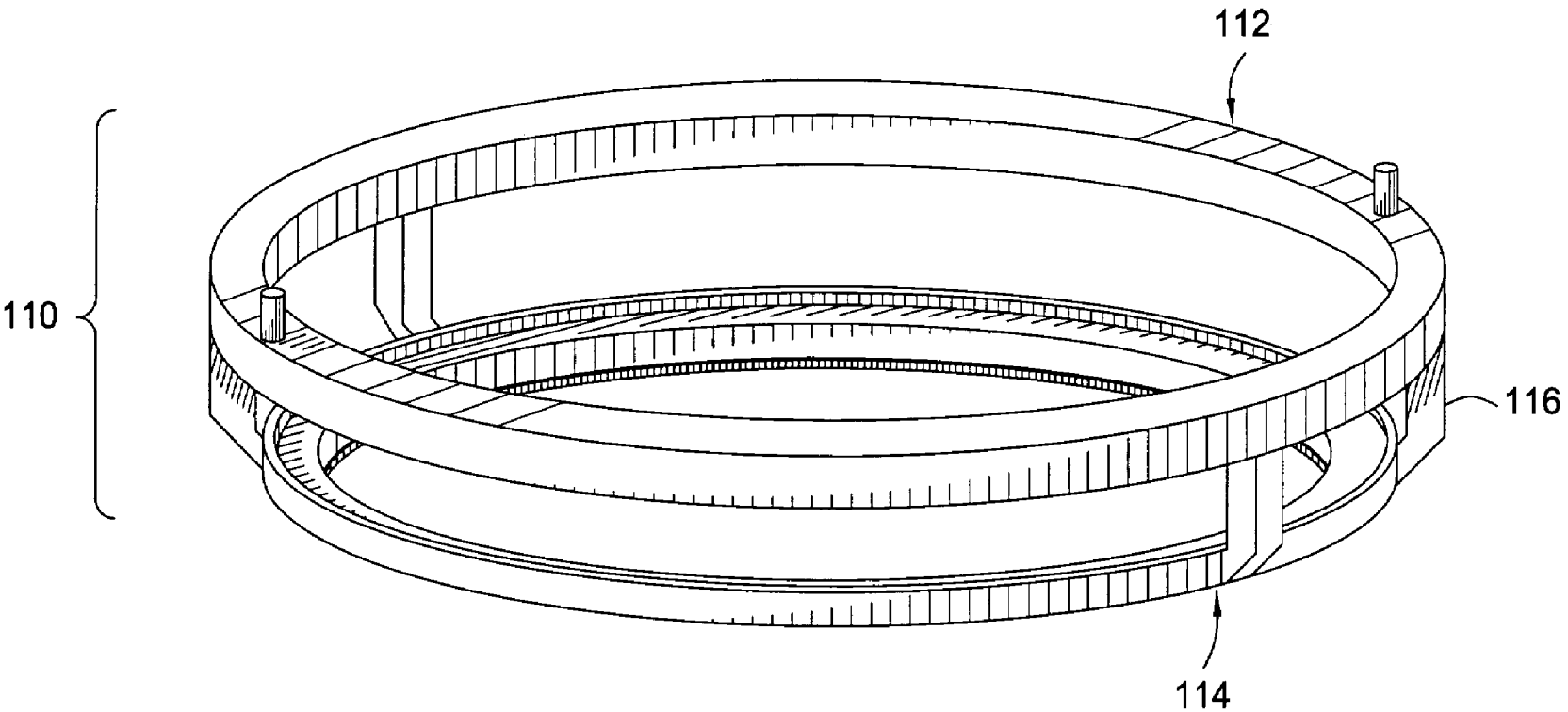
FIG. 2 is a perspective view of an exemplary contact ring of the invention with a thrust plate positioned in contact with the contact ring.
Figure 3:
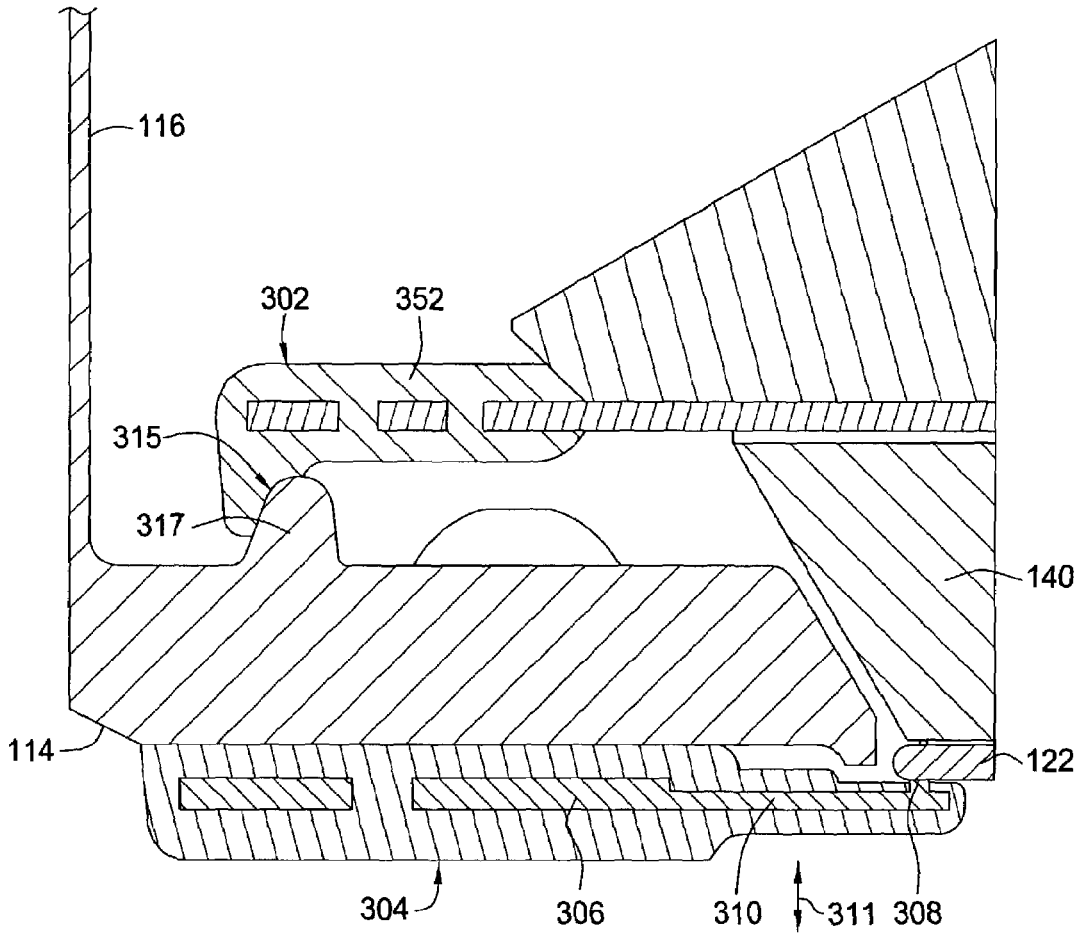
FIG. 3 is a sectional view of an exemplary contact ring of the invention.

The substrate holding assembly 110, which is shown in perspective in FIG. 2 and in section in FIG. 3, generally includes an upper contact ring mounting member 112 attached to lower contact ring 114 via vertical attachment/support members 116. The mounting member 112 generally allows for attachment of the substrate holding assembly 110 to the head actuator assembly 102. The upper contact ring-mounting member 112 is generally configured to receive electrical power from the power supply (not shown) and conduct the electrical power through the support members 116 to the contact pins 310 in the lower portion 114 of the contact ring. The electrical power is generally conducted through the respective elements via an internal conductive portion (not shown) of the respective members. Alternatively, mounting member and support members 116 may be manufactured from a conductive material, and as such, the members themselves may be used to conduct the electrical power to the contact pins 310. However, in this embodiment the conductive surfaces of the respective members is generally coated or covered with an electrically insulating material, as exposed conductive surfaces will be plated on when the assembly is immersed in a plating solution. In one embodiment of the invention the conductive surfaces of the substrate holding assembly 110 are coated with a PTFE material, such as Aflon®, Viton®, or any other suitable plating-resistant coating material.

Figure 4:
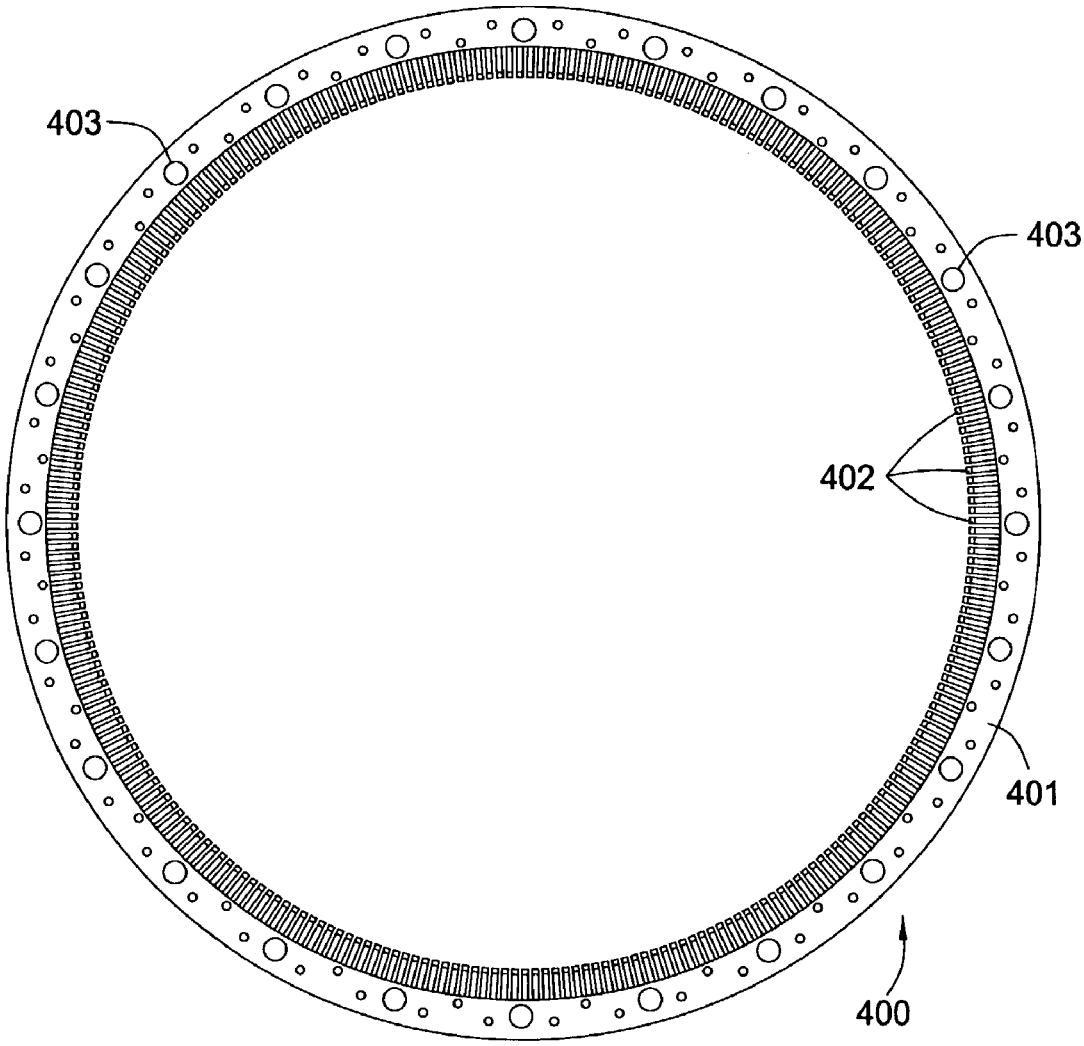
FIG. 4 is a plan view of an exemplary contact pin ring of the invention.

The lower contact ring portion 114 generally extends radially inward of the support members 116. Additionally, ring portion 114 generally includes the contact pins 310, either through an integrated manufacturing process or through an add on process. For example, FIG. 4 illustrates a plan view of an exemplary contact pin ring 400, wherein ring 400 is configured to be secured to the lower ring portion 114 to form contacts pins 310. The contact pin ring 400 generally includes an outer base portion 401 that has a plurality of flexible electrical contact elements 402 extending radially inward therefrom. The base portion 401 also generally includes a plurality of holes 403 formed therethrough, which allow for ring 400 to be bolted, brazed, or otherwise affixed to a lower surface of a contact ring assembly, such as assembly 110, for example.

Returning to FIG. 3, the substrate holding assembly 110 generally includes the upper member (not shown in FIG. 3), the support or middle member 116, and the ring member 114. A contact pin assembly, such as ring 400 illustrated in FIG. 4, is generally attached to the lower surface of ring 114 if the contact pins 310 are not integrally manufactured into ring member 114. The exemplary contact pin assembly illustrated in FIG. 3 includes a conductive core member 306, which may be manufactured from stainless steel, copper, gold, or other conductive material, that also has at least a minimal amount of flexibility at room temperatures or slightly below, e.g., at the temperature of an electrochemical plating solution in an ECP process. The conductive core 306 is generally coated with an electrically insulative layer 304 that is resistant to plating solutions, i.e., the coating does not react with plating solutions or facilitate plating on the coating. The insulating layer 304 is generally a Viton® or Aflon® layer, or a layer of another material that is both electrically insulative and resistant to electrochemical plating solutions, as well as being flexible and//or capable of bending without cracking, breaking, or otherwise allowing the plating solution to permeate through the coating to the underlying layer.

The contact pins 310 are generally positioned on the contact ring 114 in a configuration such that the contacts 310 contact the perimeter of a substrate positioned on the contact ring 114, e.g., the contact pins 310 are generally positioned in an annular pattern and extend radially inward, such that a perimeter of a substrate may be supported by the terminating ends/contact points 308 of the contact pins 308. The contact pins 310 may vary in number, for example, according to a size of the substrate being plated. Further, the contact pins 310 may be made of any suitable conductive material, such as copper (Cu), platinum (Pt), tantalum (Ta), titanium (Ti), gold (Au), silver (Ag), stainless steel, indium, palladium and alloys thereof, or other conducting materials amenable to electrochemical plating processes. However, embodiments of the invention contemplate using only conductive materials that have a degree of flexibility (not completely rigid) at conventional plating temperatures, i.e., the temperature of a plating bath during an ECP process. Power may be supplied to the contacts 310 via a power supply (not shown). The power supply may supply electrical power to all of the electrical contacts 310 cooperatively, banks or groups of the electrical contacts 310, or to each of the contacts 310 individually. In embodiments where current is supplied to groups or individual contacts 310, a current control system may be employed to control the current applied to each group or bank of pins.

Contacts 310, which are generally shown in FIG. 3, are generally attached to a lower surface of the contact ring 114. However, embodiments of the invention are not limited to this configuration, as it is contemplated that the contacts 310 may be integrally formed into the contact ring 114, or alternatively, attached to the contact ring 114 in a different configuration. Each of the individual contact pins 310 includes an electrically conductive core 306. The conductive material used to manufacture the core 306 is generally selected to be both conductive and flexible, as the individual contact pins are configured to be flexible in at least one direction. More particularly, each of the contact pins 310 are generally configured to move vertically, i.e., in the direction of arrow 311, in order to facilitate engagement of a substrate that is not completely planar. For example, if a substrate is not completely planar (or if the contact pins are not aligned in a horizontal plane), then a substrate that is positioned in the contact ring of the invention will engage some of the contact pins 310 and not others Thus, each of the individual contact pins 310 are configured to be flexible so that this type of situation may be remedied via application of pressure to the backside of the substrate. This pressure causes the substrate to press against the contact pins 310 and slightly deflect the pins downward in the direction of arrow 311. This downward deflection causes the substrate to engage the remaining contact pins 310 that were not previously engaged. Thus, the flexibility of the contact pins 310 allows for optimal contact with the substrate, ie., all of the contact pins 310 are caused to electrically engage the substrate.

The insulating layer 304 is formed onto the conductive surfaces of the upper ring member 112, the vertical support members 116, and the lower ring member 114 in order to simplify manufacturing processes and decrease cost. More particularly, in conventional contact ring applications a conductive core had to be formed into the insulative body of the contact ring, which is a costly and time consuming process. Embodiments of the invention solve this problem by manufacturing the contact ring components from conductive materials and then coating the conductive surfaces with the insulating layer 304. If desired, various insulating layers may be utilized, i.e., one insulating material (a rigid material, for example) may be used to coat the ring components 112, 114, and 116, and then another insulating layer (a flexible layer, for example) may be used to coat the contact pins 306.

In order to apply pressure to the substrate to cause pins 310 to flex, the thrust plate 140 discussed in FIG. 1 is generally utilized. More particularly, the thrust plate 140 is generally actuated in a vertical manner to physically engage the backside of the substrate being positioned in the contact ring 114 for plating. The thrust plate 140 pushes against the backside of the substrate to mechanically bias the substrate against the contacts 310, and during this process the pins 310 that are in engagement with high spots on the substrate or the pins that are positioned higher (vertically) than other pins 310 are caused to flex or bend downward. This downward motion allows for the remaining contact pins 310 to also engage the substrate, and as such, all of the contact pins 310 are brought into physical and electrical engagement with the substrate.

Additionally, thrust plate assembly 140 may also include seal means configured to prevent liquid from extending over the backside of the wafer. The seal means is desirable, as it operates to prevent backside fluid contact from occurring. This makes it easier to remove any backside deposition residue and helps to ensure that the robot blade gets a dry wafer to apply vacuum on. The seal member 302 is generally positioned on an upper portion of the thrust plate 140 and is configured to engage an upper portion of the contact ring 114 when the thrust plate 140 is extended and in contact with a substrate 122. The seal 302 generally includes a curved sealing surface 315 that is configured to engage a seal bump 317 formed on the upper surface of the contact ring 114. Both the sealing surface 315 and seal bump 317 are generally annularly shaped and of the same radius, so that the bump and surface meet contiguously when the thrust plate is extended. Generally, the seal 302 may operate to prevent plating solution from flowing over the outer perimeter of the contact ring 114 and to the backside of the substrate being plated. The sealing member 302 may be manufactured from materials such as nitrile, buna-n, silicone, rubber, neoprene, polyurethane and teflon encapsulated elastomers. Additionally, seal 302 may be manufactured at least partially of a perfluoroelastomer material, such as perfluoroelastomer materials sold under the trade names Chemraz®, Kalrez®, Perlast®, Simriz®, and Viton®. Further, the insulative coating applied to the contacts 310 may be coated with the same material that the seal 302 may be manufactured from.

Sealing member 302 may include a body portion 352 attached to the thrust plate assembly 140 and an annular portion 315 extending from the base portion 352. As illustrated, the annular portion 315 may be substantially perpendicular to the body portion 352. The sealing member 302 may be adapted to engage the annular ring 118 formed on the top surface of the contact ring 114 with the annular portion 315. Particularly, an inner surface of the annular portion 315 may engage an outer surface of the annular bump/ring 317. Thus, the annular portion 315 may exert a radial sealing force ($F_{RADIAL}$) directed radially inward, i.e., substantially parallel to the substrate 120.

The size and shape of sealing member 302 may be designed to ensure adequate radial force is generated to provide adequate sealing. For example, an outer diameter of the back side radial seal 302 (to an outer surface of the annular portion 315) may be chosen to be slightly larger (e.g., less than 5 mm) than an outer diameter of the bump 317. As the thrust plate 140 is lowered to secure the substrate 120, the annular portion 315 may flex radially outward to engage the annular bump 317, resulting in an adequate radial seal without excessive downward force. Further, as illustrated, an inner edge of the back side sealing member 302 where the annular portion 315 extends from the body portion 352 may be substantially rounded to mate with a substantially rounded top surface of the annular bump 317.

In another embodiment of the invention, each of the individual contacts 310 include conductive tip members affixed to the distal contact point of each of the contacts 310. The tip members are generally manufactured from copper (Cu), platinum (Pt), tantalum (Ta), titanium (Ti), gold (Au), silver (Ag), stainless steel, indium, palladium, and/or alloys thereof. Using this configuration, the core portion 306 of the contact ring may be manufactured from a more cost effective material, while the portions of the contact ring that electrically engage the substrate surface, i.e., the distal ends 308 of contacts 310 may be manufactured from a material that has improved electrical contact characteristics over the core material. Although the core of the contact ring may be manufactured from the same material used to electrically contact the substrate, manufacturing the core from the contact/tip material will generally increase the cost of the contact ring substantially. Therefore, in order to maintain a cost effective contact ring, while also providing improved electrical contact characteristics between the contact ring and the substrate, embodiments of the present invention utilize a contact ring that includes a cost effective core portion that has a material that provides improved electrical contact characteristics brazed or otherwise affixed to the distal portions 308 of the contact fingers 310.

The contact ring of this embodiment may include a core that is manufactured from a standard steel, such as stainless steel, for example. The core provides a conductive medium through the main body of the contact ring and generally provides the supporting structure or backbone of the contact ring. However, since steel generally provides poor electrical contact characteristics with semiconductor substrates and reacts poorly with electrochemical plating solutions, the terminating end or contact point 308 of each of the contact fingers 310 may include a portion of another metal. For example, each of the tips 308 may have a slug of (Cu), platinum (Pt), tantalum (Ta), titanium (Ti), gold (Au), silver (Ag), indium, palladium, and/or alloys thereof brazed thereto. The slug that is brazed to the contact tip 308 may be sized and shaped for optimal substrate contact.

Further, since the contact ring of the invention generally includes a plurality of contact fingers 402, as illustrated in FIG. 4, the process of brazing slugs to each of the contact tips 308 may generally include a single brazing operation that may then be separated into the plurality of fingers 402. For example, when the contact ring of the invention is manufactured, finger portions 402 may be manufactured last. In this process the outer ring 401 (base portion) may first be formed. The process of forming the outer ring 401 may further include forming an inner ring that may be subsequently used to form fingers 402, however, the inner ring is left as a solid at this point in the process. The cross section of the inner ring is generally manufactured to be the same cross section as the contact fingers 402 (including the contact tips that will be formed later). In this configuration a ring of material (tip ring) may be brazed to the annular contact tip portion of the inner ring before the finger portions 402 are formed. The tip ring portion, which is generally synonymous with the slug discussed above, may be formed of a material that provides optimal electrical contact characteristics with substrates, adheres well to the core material of the contact ring, and reacts favorably to electrochemical plating solutions. Exemplary ring materials include platinum, tantalum, titanium, indium, palladium, and alloys thereof.

Once the tip ring member has been brazed to the contact tip portion of the contact ring, then the contact finger portions 402 may be formed from the inner ring having the tip ring brazed thereto. This process may generally include cutting the spaces that are between fingers 402 from the inner ring. Thus, since the inner ring is generally a solid annular piece that has the tip ring brazed thereto, a plurality of cuts may be made into the inner ring to form the fingers. For example, cuts may be made close to each other, which leaves an extending portion of the ring remaining between the cuts. This extending portion may be configured to be the contact fingers 402 of the contact ring. Therefore, the desired width of the contact fingers may be determined by the spacing of the cuts of the inner ring. Further, since the tip ring portion is brazed to the inner ring, when the cuts are made, each individual finger is formed with a razed tip thereon, which would not be easily accomplished if each tip were to be brazed onto each finger individually.

While the foregoing is directed to embodiments of the present invention, other and further embodiments of the invention may be devised without departing from the basic scope thereof, and the scope thereof is determined by the claims that follow.

What is claimed is:

1. A contact ring for an electrochemical plating system, comprising:

an upper ring member;

a lower ring member secured to the upper ring member via a plurality of support members, the lower ring member having an inwardly extending flange;

a plurality of vertically flexible conductive contact pins extending radially inward from the lower ring member;

an electrically insulating layer covering the plurality of the vertically flexible conductive contact pins;

a plurality of conductive tip members affixed to a terminating end of each of the plurality of vertically flexible conductive contact pins, wherein the conductive tip members extend radially inward from each of the vertically flexible conductive contact pins; and an annular bump member formed onto an upper surface of the lower ring member, the annular bump member being configured to engage an annular seal member attached to a thrust plate assembly.

2. The contact ring of claim 1, wherein the upper ring member, lower ring member, support members, and the flange are manufactured from a conductive material.

3. The contact ring of claim 2, wherein the conductive material comprises stainless steel.

4. The contact ring of claim 1, wherein tip members are manufactured from at least one of platinum, tantalum, titanium, indium, palladium, and alloys thereof.

5. The contact ring of claim 1, wherein the plurality of conductive tip members are brazed to the terminating ends of the plurality of vertically flexible conductive contact pins.

6. The contact ring of claim 1, wherein the electrically insulating layer provides a continuous insulating layer to the plurality of vertically flexible conductive contact pins during vertical movement of the contact pins.

* * * * *